United States Patent [19]

Durant

[11] Patent Number: 4,612,964

[45] Date of Patent: Sep. 23, 1986

[54] COMBINED AUGER AND AIR-TYPE VALVE BAG FILLING MACHINE

[75] Inventor: Will G. Durant, Tustin, Calif.

[73] Assignee: Westmont, Inc., Santa Fe Springs, Calif.

[21] Appl. No.: 718,660

[22] Filed: Apr. 1, 1985

[51] Int. Cl.[4] ..... B65B 1/18

[52] U.S. Cl. ..... 141/68; 222/251

[58] Field of Search ..... 141/1, 10, 68, 128; 406/56, 61; 222/251

[56] References Cited

U.S. PATENT DOCUMENTS

| | | | |
|---|---|---|---|
| 1,254,393 | 1/1918 | Clendon | 406/56 X |
| 3,252,630 | 5/1966 | Berg | 141/128 X |
| 3,578,041 | 5/1971 | Obara | 141/68 X |
| 3,970,159 | 7/1976 | Hahn | 141/128 X |

*Primary Examiner*—Stephen Marcus

*Assistant Examiner*—Mark Thronson

*Attorney, Agent, or Firm*—Leonard Tachner

[57] ABSTRACT

A valve bag filling apparatus that combines an auger-type feed and an air pressure-type feed in a unitary filling system for filling valve bags with flowable particulate material at higher speed and with greater accuracy. A concentric tube configuration is used to deliver such material at high speed into the bag during a major portion of the filling cycle with both feed systems acting simultaneously. A novel cutoff tube closes an annular air feed passage during the final portion of the filling cycle when the auger feed portion of the system completes the bag filling operation at a highly accurate and readily controlled low feed rate. Air purge jets clear the air passage of remaining material during the final portion of the filling cycle. A unique fluidizing section of the apparatus aerates the product and feeds it into both the auger and air passage during high speed filling.

14 Claims, 6 Drawing Figures

COMBINED AUGER AND AIR-TYPE VALVE BAG FILLING MACHINE

BACKGROUND OF THE INVENTION

1. Field of the Invention

The present invention relates generally to apparatus for filling valve bags with a flowable particulate material until a precise preselected weight of such material is contained within the bag. More specifically, the present invention relates to a valve bag filling machine which advantageously combines features of an auger-type filling machine and an air flow-type filling machine for increased productivity and accuracy in filling valve bags.

Valve bags are of the type that comprise a top which is open at one end so as to be able to receive the filling spout of a filling machine. The principal advantage of such bags is that they close automatically when filled and removed from the machine so that no special sealing procedures are needed to close the bags at their top subsequent to their being filled.

2. Prior Art

Both auger-type bag filling machines and air flow-type bag filling machines are well-known in the art. Typically, manufacturers of products in the form of a flowable particulate material such as various chemical powders utilize one or the other type of bag filling machine to fill a valve bag with such material to a preselected weight. In carrying out the filling process there are two inherently conflicting requirements. One such requirement is to fill the bag as accurately as possible to the desired weight. The other requirement is to fill the bag as quickly as possible so that the bag filling process does not become too time consuming and costly in the overall process of delivering the particulate material to the marketplace.

Auger feed machines typically are capable of filling bags to a high degree of weight accuracy by virtue of the fact that the auger feed device is capable of maintaining a consistent and measurable flow rate for most products. Weight accuracy is achieved by reducing the delivery rate at the end of the filling cycle to most closely approach the precise desired weight without substantially overfilling the bag which would reduce the profit to the manufacturer. However, auger-type filling machines have an inherent problem in the delivery rate during the first ninety five percent or so of the filling cycle. More specifically, the auger delivery rate is typically relatively slow. The rate is a function of auger capacity, efficiency of loading and the bulk density of the product. Typically, in an attempt to maximize the delivery rate, augers are made large. However, this tends to reduce the accuracy because the flow stream during the final stages of filling at low speeds is not as consistent as desirable.

Air flow pressure packers on the other hand are traditionally faster filling machines than comparable auger packers. The air flow packer fluidizes the product and drives the fluidized product into the bag at higher rates than are normally attainable with auger fillers. The difference in filling rates between air flow packers and auger packers is particularly evident when bags are being filled with lighter density materials. The inherent problem with air flow packers relates to back pressure. More specifically, the back pressure in the bag affects the consistency of the flow stream. The delivery rate is a function of the pressure differential between the chamber pressure from which the material emanates and the bag pressure into which the material flows. As the bag becomes filled, the pressure in the bag builds as venting through the bag is restricted. Consequently, the flow rate begins to deteriorate near the end of the filling cycle. However, it is at this time that the consistency of the flow rate is required to achieve maximum accuracy for final weighing of the bag. Consequently, it is difficult to achieve extremely high accuracy on powdered products when utilizing air flow filling. In addition, certain powders create a considerable amount of dust towards the end of the filling cycle.

Consequently, it will be evident that manufacturers of flowable particulate material which are shipped in valve bags have had to make a difficult choice between accuracy and filling rate depending upon whether they selected an auger-type bag filling machine or an air flow-type bag filling machine.

SUMMARY OF THE INVENTION

The novel valve bag packing machine of the present invention is designed to utilize the higher speed air flow filling principal to fill the valve bag to approximately ninety eight percent of its final desired weight. However, the machine is uniquely designed to then deliver the final two percent of the product into the bag by means of a small slow turning auger delivering product at a slow, consistent and highly accurate rate. This results in a novel machine capable of filling valve bags with powdered and granulated dry products at a rate not achievable with normal auger fillers and at an accuracy and degree of cleanliness not achievable with air flow packers.

The combined auger and air valve bag filling machine of the present invention employs a novel feed system which consists of a concentric, double-tube apparatus. An inner core casing houses a feed auger. The inner core casing is surrounded by an outer casing creating an annular area between the two casings. This annular area is utilized as an air delivery passage for the product. The auger drive shaft extends rearwardly through a transition section and is supported by bearings. A forward bearing is supported in the transition section in a specially designed air gland housing. The rear bearing is supported in the rear framework where the auger shaft is driven by a V-belt drive attached to an electric motor which may be either of a fixed speed or variable speed configuration.

The auger and auger casing extend forward into a filling spout which is designed to receive a conventional valve bag for delivering particulate product into the bag. The product is delivered from a hopper through an opening in the auger casing located in the product transition section of the machine. The air flow feed system employs an air inlet valve, pressure tank and related pressure and vent valve manifold. A novel transition and fluidizing section employs fluidizing pads and a special exit nozzle to allow fluidized product to escape through a bell-shaped exit nozzle surrounding the auger casing. Both the air feed and auger feed portions of the system are in operation during ninety eight percent of the bag filling process, that is, while the first ninety eight percent of the product weight is placed into the bag. During the last two percent of the filling process, the air feed portion of the apparatus is cut off. This is accomplished by a coaxial rubber tube which is housed in a pressure jacket surrounding the central portion of the auger casing. The tube is pressurized and compressed around three radial vanes protruding symmetrically from the auger casing. The pressurized jacket stops the fluidized product from continuing to flow. An intermediate nozzle or connector employs four specially designed jet purge nozzles to blow residual powder from the annular air tube into the bag after the tube has been pinched closed.

Although it will be seen hereinafter that the present invention comprises a number of highly advantageous and novel features the principal novel aspect of the present invention resides in its unique configuration which combines two types of bag feed systems, namely, an auger feed system and an air flow feed system in one apparatus.

OBJECTS OF THE INVENTION

It is therefore a principal object of the present invention to provide a valve bag filling apparatus which is uniquely configured to combine both auger feed and air feed capability in a unitary apparatus.

It is an additional object of the present invention to provide a valve bag filling machine which combines the high flow rate capability of an air feed system and the more accurate feed capability of an auger feed system for filling a valve bag with flowable, particulate material with combined speed and accuracy not previously achievable in the prior art.

It is still an additional object of the present invention to provide a valve bag filling machine which overcomes the low flow rates of prior art auger feed systems and the inaccuracy of prior art air pressure system by providing a single bag filling tube capable of operation with both such systems simultaneously.

It is still an additional object of the present invention to provide a valve bag filling machine which permits concurrent operation of an auger-type feed system and an air pressure-type feed system in a unitary device with means for selectively cutting off the air feed portion of the system near the end of the filling cycle whereby to provide high speed filling during most of the filling process and highly accurate filling during the end of the filling process.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment of the invention when taken in conjunction with the accompanying drawings in which.

DETAILED DESCRIPTION OF A PREFERRED EMBODIMENT

Figure 1:
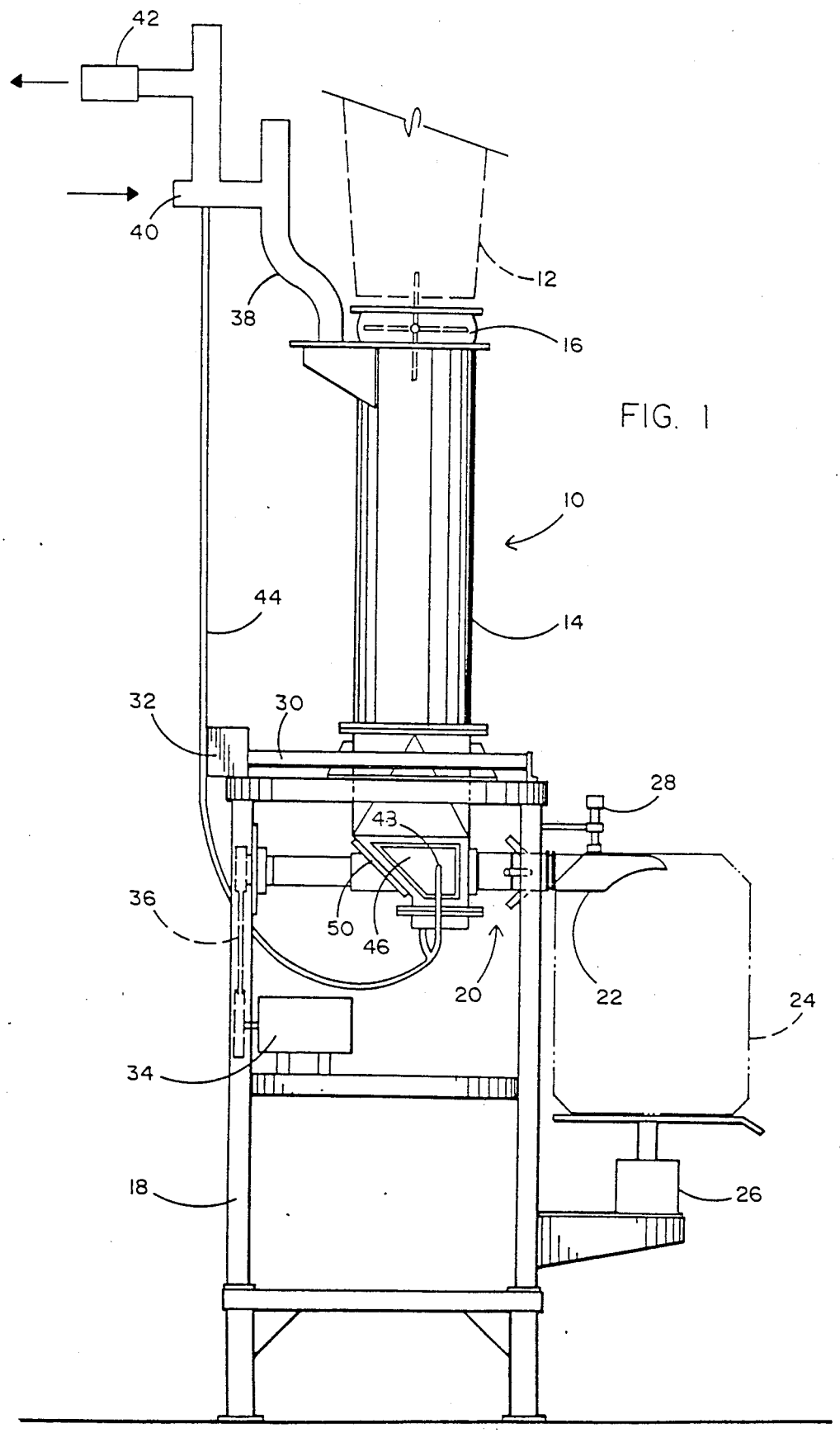
FIG. 1 is a plan view of the bag filling apparatus of the present invention shown in its bag filling and weighing configuration.

Referring first to FIG. 1 it will be seen that the bag filling machine 10 of the present invention comprises a product storage tank 12 connected to a pressurizable hopper 14 through a product inlet butterfly valve 16. The storage tank and hopper are supported on a support stand 18 on which is also secured the auger/air feed system assembly 20 of the present invention. Assembly 20 terminates in a filling spout 22 which as seen in FIG. 1, extends into the valve opening of a valve bag 24 for filling the bag with flowable particulate material. Bag 24 is supported on a bag support device 26 the influence of which on the bag weighing process during bag filling is taken into account by the known tare weight of the bag. The bag is securely affixed to the filling spout 22 by means of a clamp 28. Clamp 28 serves the dual purpose of securing the bag to the filling spout and providing means for attaching the bag to a scale beam 30 which is connected to a load cell 32 for weighing the bag during filling in a conventional well-known manner.

The auger/air feed system 20 of the present invention will be seen hereinafter to have an auger the shaft of which is connected for rotational drive to a motor 34 by means of a V-belt drive 36. As shown in FIG. 1, motor 34 is also supported on support stand 18.

As previously noted, hopper 14 is pressurizable. This feature of the hopper 14 provides a means for creating a pressure differential between the hopper and the bag as it is being filled to implement the air feed portion of the invention. In this regard, the present invention is provided with an air pressure manifold 38 connected to hopper 14 at the upper left-hand corner thereof as seen in FIG. 1. Air pressure manifold 38 comprises a low pressure inlet valve 40 and an air vent valve 42. Valves 40 and 42, operating in conjunction with product inlet butterfly valve 16 between the product storage tank 12 and hopper 14, permits selective pressurization and depressurization of hopper 14 whereby to control the air pressure differential previously noted. A fluidizing air line 44 is connected to the low pressure air inlet valve 40 at one end of providing low pressure air to a plurality of fluidizing pads 46 where the line is connected to a plurality of corresponding air couplings 43 in a product fluidizing section 50 of the invention the details of which will be disclosed hereinafter in more detail. The fluidizing air line 44 provides a means for delivering low pressure air flow to the fluidizing pads whereby to in effect, aerate the product as it flows from the hopper 14 through a transition section 50 and into the auger/air feed system 20 of the invention. Low pressure air also provides means for preventing particulate material product from inadvertently entering the bearings of the auger portion of the assembly 20 thereby increasing the reliability and durability of the invention.

Figure 2:
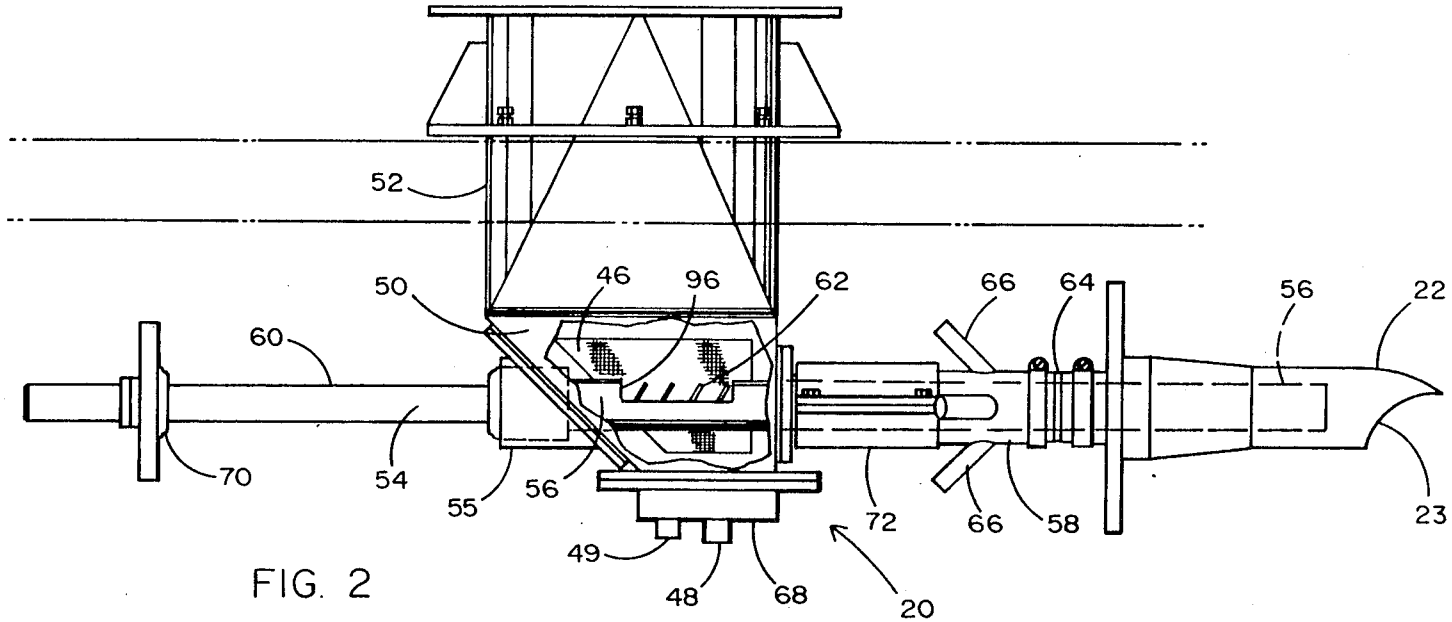
FIG. 2 is a more enlarged, partially cutaway view of the transition and feed portions of the present invention.

Reference will now be made to FIG. 2 for a more detailed description of the auger/air feed system assembly 20 of the present invention. Referring now to FIG. 2 it will be seen that the assembly 20 comprises a product fluidizing section 50 beneath a transition hopper 52. Transition hopper 52 is designed to be connected to hopper 14 of FIG. 1 and is therefore circular at its upper portion and rectangular at its lower portion where it connects to the product fluidizing section 50. Product fluidizing section 50 is a trapezoidally-shaped chamber having a plurality of fluidizing pads 46 along four of its faces. Each such fluidizing pad 46 is a canvas material pad which is designed to contain the particulate material within the fluidizing section while permitting the passage of low pressure air therethrough which percolates through the particulate material during its transitional flow from transition hopper 52 into the feed system assembly 20. By way of example, a bottom fluidizing pad 68 provides two couplings, namely, an air coupling 48 and a grease coupling 49. Air coupling 48 is by way of example, connected to a source of low pressure. The purpose of grease coupling 49 will be disclosed hereinafter in conjunction with FIG. 6.

Product fluidizing section 50 is designed to allow particulate material to flow into both the air and auger portions of the feed system assembly 20 of the invention. More specifically, by means of the novel product fluidizing section 50 of the invention, particulate material flows into an auger casing 56 which is of an elongated cylindrical configuration designed to surround an auger 54 in coaxial relation. The auger casing is provided with a product inlet portion 96 which is in the form of a semicircular cross-section cutaway of the casing 56. As a result, the particulate material enters the casing and falls into the auger 54 for translation by the auger to the filling spout 22. Auger 54 comprises an auger shaft 60 coaxially aligned with an affixed auger helix 62 in a conventional manner. Auger 54 is supported by two bearing devices, namely, a forward bearing and air seal packing gland system 55 and a rear bearing assembly 70. As seen in FIG. 2, the auger casing and auger therein extend into the filling spout 22 as seen in the right-most portion of FIG. 2 where they terminate adjacent a filling spout outlet 23. In this manner, the particulate material product is fed by the auger into the filling spout 22 for flow into the valve bag, the valve of which is connected to the filling spout as previously described in conjunction with FIG. 1.

The product fluidizing section 50 also provides means for directing particulate material product into the annular passage between the auger casing 56 and what amounts to an exterior tube casing comprising a number of serially connected tube-shaped elements, the details of which will be best understood by reference to FIG. 3 which will be described hereinafter. As previously indicated, the hopper 14 is pressurized during the major portion of the filling cycle with which the present invention is used to fill valve bags whereby particulate material product is in effect forced to flow in the annular passage between the auger casing and the outer tubes until it to exits the filling spout 22 at the outlet 23 for flowing into the attached valve bag.

Figure 3:
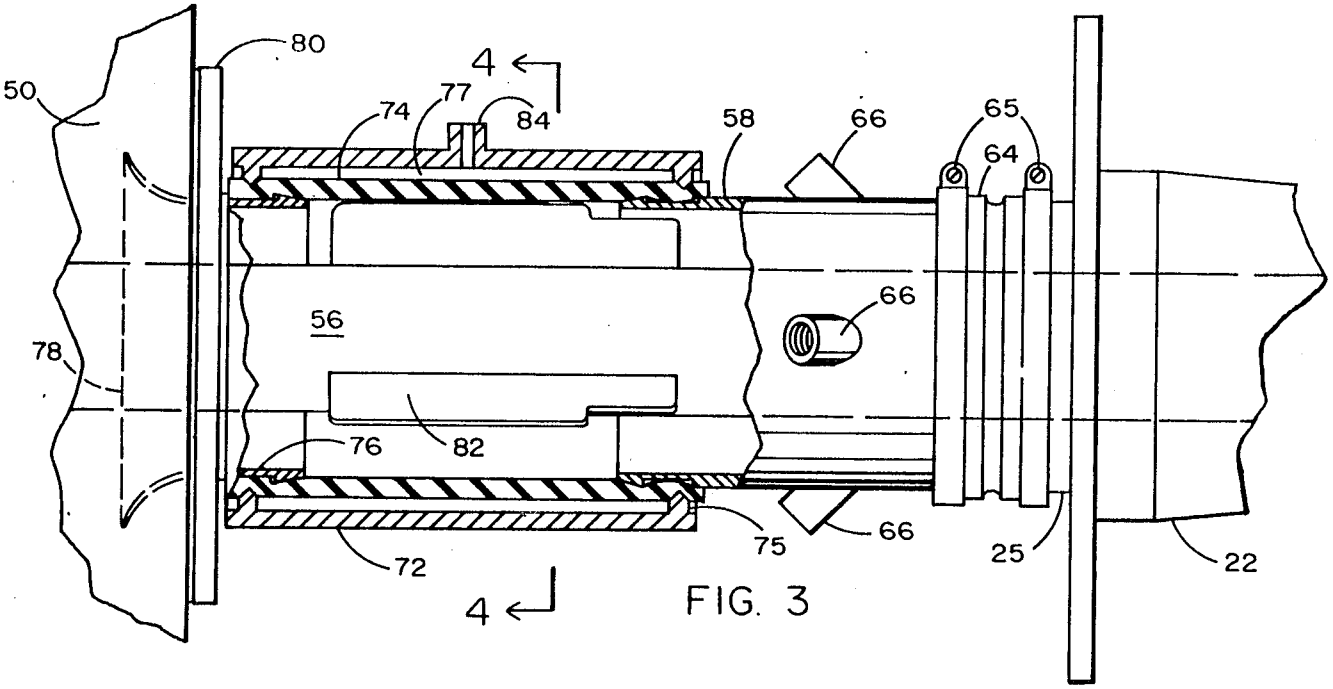
FIG. 3 is a still more enlarged cross-sectional view of the flow tube portion of the present invention.

Referring to FIG. 3 it will be seen that the right-most portion of product fluidizing section 50 is connected to a product exit nozzle 76 which has a bell-shaped opening 78 positioned within the product fluidizing section 50. Product exit nozzle 76 extends to the right in FIG. 3 and is connected to a flexible flow tube 74 which comprises one of a plurality of serially interconnected tubes forming the outer surface of the annular chamber through which the air pressure-induced, high rate flow of particulate material takes place. The left-most portion of flexible flow tube 74 is connected to the product exit nozzle 76. Its right-most portion as seen in FIG. 3 is connected to an intermediate flow tube 58 which comprises another of the sequentially connected flow tubes forming the outer surface of the annular passage for air pressure-induced flow of particulate material. Intermediate flow tube 58 is also connected to a flexible connection 64 which for purposes of bag weighing accuracy is preferably made of a highly flexible material such as neoprene and which is secured to the intermediate flow tube 58 by a hose clamp 65. Flexible connection 64 is connected by means of a second hose clamp 65 to an annular flange 25 extending from filling spout 22. In this manner the outer annular surface of the air flow passage for the particulate material propelled by the pressure differential between the hopper 14 and the bag 24, is formed by a series of sequentially connected tube-shaped elements comprising product exit nozzle 76, flexible flow tube 74, intermediate flow tube 58, flexible connection 64 and filling spout 22.

Flexible flow tube 74 is surrounded by a flow tube jacket 72 which has a clam shell configuration of about the same length as flexible flow tube 74 and which is provided with a pair of annular ridges 75 at opposite ends thereof. These annular ridges 75 each have pointed radial edges for biting into the exterior surface of flexible flow tube 74 whereby to form an airtight annular chamber 77 between flow tube jacket 72 and flexible flow tube 74. As seen further in FIG. 3, flow tube jacket 72 is provided with an air pressure coupling 84 adapted for connection to a source of air pressure supply for pressurizing chamber 77 the purpose of which will be discussed hereinafter in conjunction with FIGS. 4 and 5. As seen further in FIG. 3, auger casing 56, in the region of tube 74, is provided with a plurality of vanes 82 extending radially therefrom towards the interior surface of flow tube 74. In the particular embodiment of the invention herein disclosed, three such vanes spaced symmetrically around the radial surface of auger casing 56 are provided.

Intermediate flow tube 58 is provided with a plurality of symmetrically spaced purge nozzle jets 66 which are configured diagonally relative to the longitudinal axis of the auger casing 56 and which provide means for injecting pressurized air into the annular passageway between the auger casing and the intermediate flow tube during a selected portion of the filling cycle whereby to purge the passageway of any remaining particulate material product after the flow portion of the filling cycle has been terminated by closing the passageway between the auger casing and the flexible flow tube 74. The manner in which the opening and closing of the air passageway may be controlled by means of the present invention may be best understood by referring to FIGS. 4 and 5.

Figure 4:
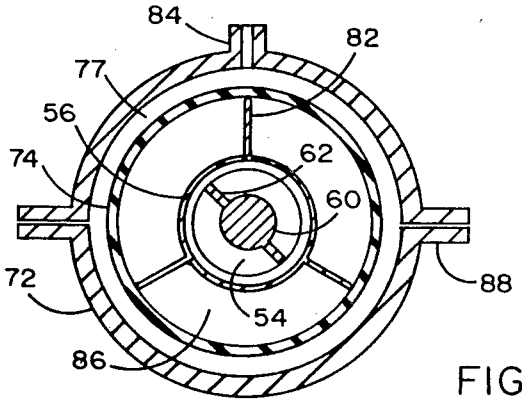
FIG. 4 is a cross-sectional view of the flow tube of the present invention taken along lines 4—4 of FIG. 3 and illustrating the configuration of the flow tube during concurrent air and auger feed operation thereof.

As seen in FIG. 4, the cross-section of that portion of the auger/air feed system 20 taken along lines 4—4 of FIG. 3 comprises the outer flow tube jacket 72, the flexible flow tube 74, the auger casing 56 and the auger 54 having a central shaft 60 and a helix 62. The space between the flexible flow tube 74 and the auger casing 56 forms an annular passageway 86 through which the flowable particulate material product is fed during the high speed portion of the bag filling cycle while simultaneously additional flowable particulate material product is fed, albeit at a lower speed, into the bag by the auger 54. The flow tube jacket 72 is in the form of a clam shell configuration having opposed pairs of axially extending flanges 88 which are adapted to be secured to one another for securely enclosing the respective halves of the flow tube jacket about the flexible flow tube 74. In this manner the annular ridges 75 are sure to be in secure airtight engagement with the flow tube whereby chamber 77 of annular configuration formed between the flow tube and the jacket may be readily pressurized by means of air pressure coupling 84 and a suitable source of air pressure. It will be recognized that the configuration of the auger/air feed system assembly seen in FIG. 4 corresponds to the period when the pressure in chamber 77 is at a substantially ambient level. Consequently, the flexible flow tube 74 is relaxed and the passage 86 between the interior surface of flexible flow tube 74 and auger casing 56 is open to the maximum extent possible to permit the highest possible flow rate of the particulate material therethrough.

Figure 5:
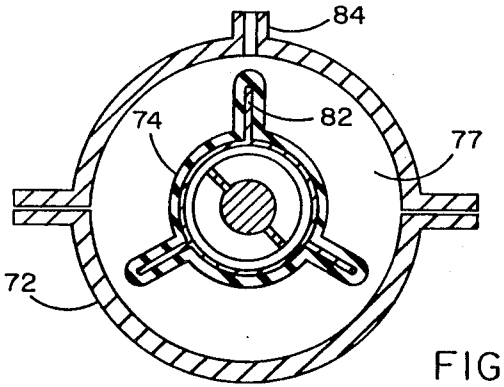
FIG. 5 is a view similar to that of FIG. 4 but illustrating the flow tube configuration when the air feed portion thereof is cut off.

On the other hand, the configuration illustrated in FIG. 5 corresponds to the same cross-sectional view of FIG. 4 but with air pressure applied through air pressure coupling 84 to substantially increase the air pressure in chamber 77. As a result, the flexible flow tube 74 is forced inwardly towards the auger casing 56 and vanes 82 until it substantially conforms to the surface of the casing and vanes. Tube 74 thereby entirely closes off the annular passage 86 stopping the flow of particulate material through the annular region between the auger casing and the flow tube. Of course it will be understood that the auger operation is not affected by the pressurization of chamber 77 and the flow of particulate material into the bag may be continued at a substantially reduced rate by means of the auger alone.

Figure 6:
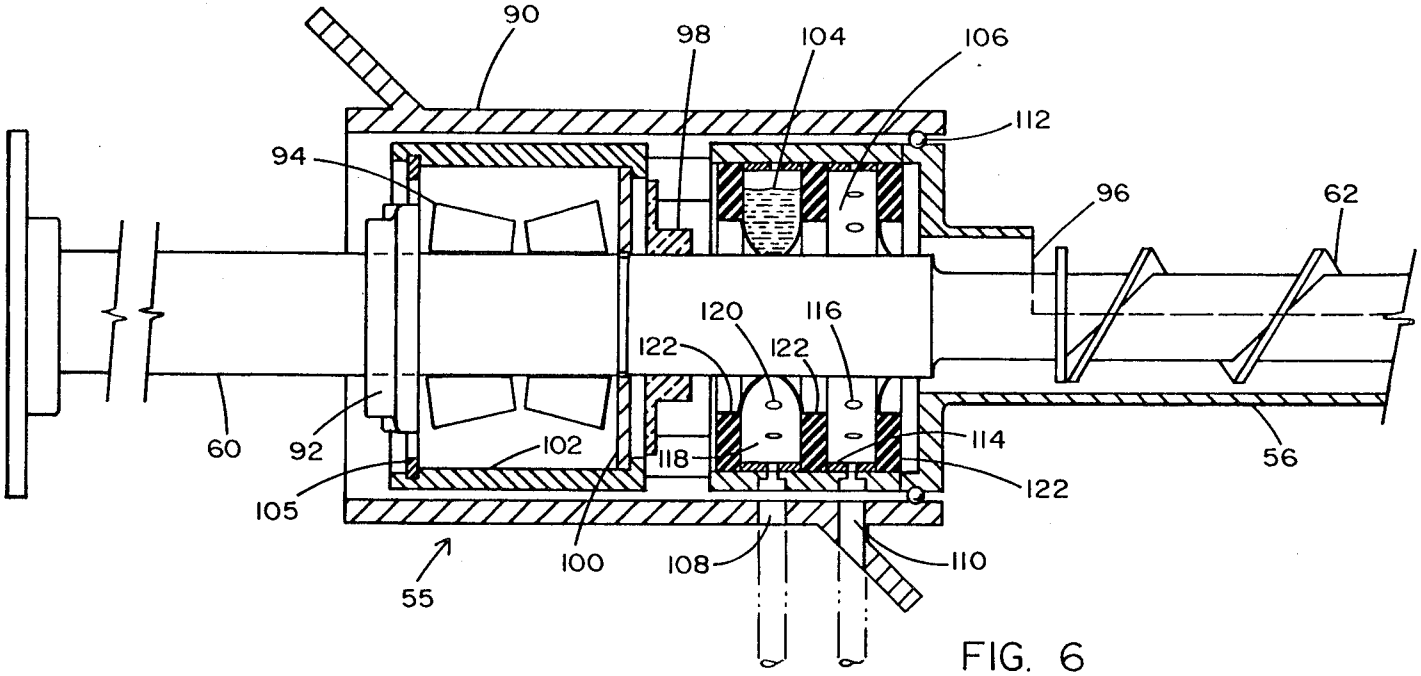
FIG. 6 is an enlarged cross-sectional view of the forward bearing and air seal packing gland system portion of the invention.

The forward bearing and air seal packing gland system 55 of the invention is shown in detail in FIG. 6. More specifically, as seen in FIG. 6, system 55 comprises a bearing mount 90, an auger forward bearing 92, a tapered roller bearing 94, a slinger ring 98, a backup ring 100 and a forward bearing casing 102. Assembly 55 is designed to provide axial support for the auger which passes through the center of the system immediately behind the product inlet 96 adjacent the termination of the auger helix 62. As seen further in FIG. 6, the auger casing 56 extends into the bearing mount 90 into which it is concentrically engaged in sealed relation by an O-ring seal barrier 112.

Forward bearing and air seal packing gland system 55 provides a dual function. First it acts as the forward bearing for the auger by which, in conjunction with the rear bearing 70 of FIG. 2, the auger is fully supported at its rear end at two points so that its weight need not be supported at its front or nozzle end where it would otherwise interfere with the weighing capability of the machine as it relates to the bag filling operation. For this purpose system 55 is provided with a forward bearing casing 102 which houses tapered roller bearings 94 which radially engage the exterior surface of the auger shaft 60. As seen in FIG. 6, shift 60 is of larger outer diameter along the portion extending through system 55. In addition, an auger forward bearing 92 is provided as seen in the left-most portion of FIG. 6. A snap ring 105 provides the appropriate interface between the forward bearing casing 102 and the forward bearing 92. The right-most portion of forward bearing casing 102 is provided with a slinger ring 98, the principal purpose of which is to prevent any particulate material product, which may inadvertently enter the area adjacent the forward bearing assembly, from entering the assembly where it might otherwise interfere with the engagement between the auger shaft and the bearing.

The principal means for preventing particulate material from entering the bearing portion of system 55 relates to the second function of the system, namely, the packing gland portion thereof which is also formed within the forward bearing casing 102 but along the right-hand portion thereof. More specifically, forward bearing casing 102 is also provided with a grease packed chamber 104 and an air distribution chamber 106. A grease port 108, which is connected to the grease coupling 49 of FIG. 2, provides access to the grease packed chamber 104 for injecting grease therein. A spacer 118 having a plurality of grease distribution holes 120 is positioned in an annular configuration within the grease packed chamber 104. To the right of grease packed chamber 104 is air distribution chamber 106. Access to chamber 106 is provided by a low pressure air port 110 which is connected to air coupling 48 of FIG. 2 to provide a means for connecting the chamber to a source of low pressure air. An annular spacer 114 is located within chamber 106 and is provided with a plurality of spaced air distribution holes 116 which permit the air injected into the chamber to circulate therein and to flow to the right into auger casing 56. Those having skill in the art to which the present invention pertains will observe that the air seal packing gland portion of system 55 serves the purpose of utilizing air flow to prevent any inadvertent flow of particulate material from the product inlet 96 to the forward bearing portion of system 55. In addition, the grease chamber 104 serves to further limit the possibility of such particulate material entering the bearing portion of system 55. A plurality of lip seals 122 isolate chambers 104 and 106 from one another and assure air flow in the appropriate direction relative to the product inlet 96.

In operation, a bag 24 is first placed on the filling machine 10. More specifically, the bag is placed on filling spout 22 and clamped in secure position by clamp 28. The filling cycle is then activated by opening valve 40 of FIG. 1 to admit fluidizing air into the fluidizing pads 46 at the bottom of the product fluidizing section 50 to precondition the product. The weight of the container is then tared to zero and the pressure chamber butterfly valve 16 is closed, sealing hopper 14. In addition, the low pressure air valve 40 pressurizes the chamber with the vent valve 42 being closed. The auger motor 34 starts and the product exit valve in the form of flexible flow tube 74 is opened whereby product flows under air pressure and within the auger into the bag. The actual rate of flow is approximately 7 to 10 pounds per second through the air passages and between 0.1 and 0.2 pounds per second by way of the auger. When the bag has been filled to approximately ninety percent of its desired weight, tank pressure is reduced by opening vent valve 42 to atmosphere thereby reducing the pressure in hopper 14. This slows the air drive feed rate. This is done to improve the accuracy of the air flow cutoff to permit complete air cutoff at about ninety eight percent of the bag weight without overrunning the desired bag weight. At a present weight approximately equal to ninety five to ninety eight percent of the full bag weight desired, the air flow driven product is stopped by activating the flexible flow tube 74. At this point, hopper 14 is completely vented and the product continues to flow only with the auger delivery at the previously indicated slower rate. At a final cutoff point, the auger stops and reverses momentarily to stop all product flow. A small amount of product in free fall continues into the bag. In addition, residual product lying in the annular passage 86 between the auger casing 56 and the spout 22 is blown into the bag by opening the air jets 66 briefly. The final weight of the bag is then examined. In the event that the final weight of the bag is below the desired weight, the auger is restarted to top off the bag weight, bringing it to precisely or slightly above the desired weight. At this point, product inlet valve 16 is reopened, readmitting product into hopper 14 and after a brief delay clamp 28 raises, releasing the bag and completing the fill cycle.

Those having skill in the art to which the present invention pertains will now understand that the applicant has disclosed a novel bag packing machine designed to utilize the higher speed air flow filling principal to fill a valve bag to approximately ninety eight percent of its final desired weight and then deliver the final two percent of the product into the bag by means of a small, slow turning auger delivering the product at a slow, consistent and highly accurate rate. This results in a novel machine capable of feeding powdered and granulated dry products into valve bags at a rate not achievable with normal auger fillers and at an accuracy and degree of cleanliness not achievable with air flow packers.

Although a number of highly advantageous novel features have been disclosed herein, the primary novelty of the present invention resides in a design which combines the advantageous features of air flow feed systems and auger feed systems to yield the high speed filling capability of one and the low speed accuracy of the other. Although a particular preferred embodiment of the invention has been disclosed herein, those having skill in the art to which the present invention pertains will now perceive various modifications and additions which may be made to the disclosed invention. By way of example, other means for controlling the air feed portion of the system and another means for isolating the air inlet configuration from the bearings will now occur to those having such skills, however all such modifications and additions are deemed to be within the scope of the invention which is to be limited only by the claims appended hereto.

I claim:

1. A valve bag filling apparatus of the type having a spout for receiving a valve bag for filling the bag with a flowable particulate material to a desired weight; the apparatus comprising:

at least two elongated coaxial tubes comprising an inner tube surrounded by an outer tube, the inner tube thereof housing an auger for feeding said material through said spout and into said bag at a first feed rate, the annular region between said inner and outer tubes providing a passage for feeding said material through said spout and into said bag at a second feed rate under the influence of air flow in said passage, said second feed rate being greater than said first feed rate; and means for selectively opening and closing said passage whereby said bag may be filled at a rate produced by both said first and second feed rates in combination and at an alternative rate equal to only said first feed rate.

2. The apparatus recited in claim 1 further comprising:

a pressurizable hopper for containing a supply of said particulate material;

means connecting said hopper to said coaxial tubes for feeding particulate material into said auger and into said passage.

3. The apparatus recited in claim 2 wherein said connecting means comprises a product fluidizing section through which said inner tube extends and in which said inner tube is partially cutaway for receiving particulate material, said fluidizing section being connected to said hopper and having at least one fluidizing pad for providing air flow through said material for aerating said material as it is fed from said hopper into said passage.

4. The apparatus recited in claim 1 wherein said means for selectively opening and closing said passage comprises a flexible portion of said outer tube and an outer jacket surrounding said flexible tube portion in airtight engagement to form a pressurizable chamber between said jacket and said flexible tube portion whereby air pressure applied to said chamber causes said flexible tube portion to conform to said inner tube thereby closing said passage.

5. The apparatus recited in claim 4 further comprising a plurality of vanes attached to and extending radially from said inner tube adjacent said flexible tube portion whereby air pressure applied to said chamber causes said flexible tube portion to conform to said inner tube and said vanes thereby closing said passage.

6. The apparatus recited in claim 1 wherein said outer tube comprises a flexible portion adjacent said spout to prevent the measured weight of said bag from being influenced by said apparatus.

7. The apparatus recited in claim 1 wherein said auger is supported by at least two bearings disposed at spaced intervals along said auger adjacent the end of said auger opposite from said spout whereby said auger cannot influence the measured weight of said bag.

8. The apparatus recited in claim 7 further comprising means for preventing said particulate material from inadvertently contaminating said bearings.

9. The apparatus recited in claim 7 wherein said contaminating preventing means comprises a first annular chamber surrounding said auger adjacent at least one of said bearings, said first chamber being adapted for receiving a high viscosity fluid for sealing said first chamber.

10. The apparatus recited in claim 9 wherein said contaminating preventing means further comprises a second annular chamber surrounding said auger adjacent said first annular chamber between said first chamber and said spout; and means for directing air flow into said second chamber and toward said spout.

11. An apparatus for dispensing particulate material and comprising:

a spout from which said particulate material may be dispensed;

an elongated coaxial dual tube connected at one end to said spout and having a central passage and an annular passage;

auger means for transferring said particulate material from a supply source to said spout through said central passage; and air pressure means for transferring said particulate material material from a supply source to said spout through said annular passage.

12. The apparatus recited in claim 11 further comprising means controlling said auger means and said air pressure means for causing, selectively, simultaneous and non-simultaneous operation thereof.

13. The apparatus recited in claim 12 wherein said controlling means comprises a motor connected to said auger means and a cutoff valve connected to said air pressure means.

14. The apparatus recited in claim 12 further comprising a scale for measuring the weight of a container being filled by said apparatus, said controlling means being responsive to said scale for simultaneous operation of said auger means and said air pressure means during a portion of a container filling cycle and for operation of only said auger means during the remainder of said container filling cycle.

* * * * *